United States Patent [19]

Nonaka

[11] Patent Number: 5,019,833

[45] Date of Patent: May 28, 1991

[54] PORTABLE ANTENNA APPARATUS FOR SATELLITE COMMUNICATION

[75] Inventor: Yasuyuki Nonaka, Saitama, Japan

[73] Assignee: Kabushiki Kaisha Toshiba, Kanagawa, Japan

[21] Appl. No.: 216,077

[22] Filed: Jul. 7, 1988

[30] Foreign Application Priority Data

Jul. 7, 1987 [JP] Japan ..... 62-169057

[51] Int. Cl.[5] ..... H01Q 19/12

[52] U.S. Cl. ..... 343/840; 343/872; 343/720; 343/878

[58] Field of Search ..... 343/720, 840, 872, 878, 343/915, 880

[56] References Cited

U.S. PATENT DOCUMENTS

| | | | |
|---|---|---|---|
| 2,994,870 | 8/1961 | Anderson | 343/872 |
| 3,646,564 | 2/1972 | Drislane | 343/872 |
| 3,805,281 | 4/1974 | Narita et al. | 343/720 |
| 3,918,065 | 11/1975 | Hutchison et al. | 343/872 |
| 4,804,972 | 2/1989 | Schudel | 343/840 |

FOREIGN PATENT DOCUMENTS

| | | | |
|---|---|---|---|
| 0114543 | 8/1984 | European Pat. Off. . | |
| 733429 | 3/1943 | Fed. Rep. of Germany | 343/720 |
| 0111105 | 7/1982 | Japan | 343/880 |
| 0075603 | 4/1986 | Japan . | |
| 800306 | 8/1958 | United Kingdom . | |

*Primary Examiner*—Rolf Hille
*Assistant Examiner*—Hoanganh Le
*Attorney, Agent, or Firm*—Helfgott & Karas

[57] ABSTRACT

A portable satellite broadcast signal antenna apparatus for manually transporting a satellite signal converter. The apparatus includes an antenna device for receiving the satellite broadcast signals, a device for adjusting the angle of the antenna device with respect to a predetermined plane for aligning the antenna device with a satellite, and a housing defining an interior space for receiving the satellite signal converter and the angle adjusting device therein and having an exterior surface bearing the antenna device.

6 Claims, 6 Drawing Sheets

PORTABLE ANTENNA APPARATUS FOR SATELLITE COMMUNICATION

FIELD OF THE INVENTION

The present invention relates generally to an antenna apparatus for satellite communication, and more particularly, to a portable satellite TV reception antenna apparatus for a use with an apparatus for receiving satellite TV broadcasting waves.

BACKGROUND OF THE INVENTION

Satellite communications have been used for a variety of communications. For example, a TV broadcasting system using a satellite has been developing in recent years. In such a satellite TV broadcasting system, a TV receiving system requires a microwave receiving antenna for receiving satellite TV broadcasting waves and a satellite receiver, in addition to a conventional TV receiver. The microwave receiving antenna apparatus generally comprises a wave collector such as a parabolic reflector. The satellite receiver converts signals received by the microwave receiving antenna apparatus to signals suitable for the TV receivers.

Conventionally, the microwave receiving antenna apparatus has been fixed to the ground or a building through a post. A direction adjuster is provided between the microwave receiving antenna apparatus and the post for adjusting the direction of the microwave receiving antenna apparatus to a selected satellite. The direction adjuster is adapted for adjusting both the elevation angle and the azimuth angle of the microwave receiving antenna apparatus for the selected satellite.

FIG. 1 shows an example of the conventional microwave receiving antenna apparatus. As shown in FIG. 1, the microwave receiving antenna apparatus comprises a microwave receiving antenna unit 100, a post 102 and a direction adjuster 104.

A bottom end of the post 102 is fixed to the ground 106 with concrete 108. The microwave receiving antenna unit 100 is mounted to a top end of the post 102 through the direction adjuster 104. The direction adjuster 104 adjusts the elevation angle and the azimuth angle of the microwave receiving antenna unit 100 for a selected satellite.

The microwave receiving antenna unit 100 generally includes a parabolic reflector **100*a*, an outer unit 100*b* and an arm 100*c*. Further the outer unit 100*b* comprises an antenna element, i.e., a primary feeder 100*d* and a low noise blockdown converter (referred as LNB converter hereafter) 100*e*. The primary feeder 100*d* is located on the offset focus of the parabolic reflector 100*a* for inducing 12 GHz band microwave radio signals corresponding to broadcast waves transmitted by satellites. The LNB converter 100*e* is coupled to the primary feeder 100*d*** for carrying out both an amplification of the received signals and a frequency conversion of the signals to prescribed lower frequency band signals, e.g., 1 GHz signals.

The arm **100*c* is provided for supporting the outer unit 100*b* on the parabolic reflector 100*a*. The radio signals obtained by the outer unit 100*b* is coupled to a predetermined output terminal (not shown) equipped on the parabolic reflector 100*a* through the arm 100*c*. The output radio signals of the LNB converter 100*e* or the outer unit 100*b*** are applied to a satellite receiver (not shown).

As is described above, the conventional microwave receiving antenna apparatus has been fixed to the ground. As a result, the microwave receiving antenna apparatus requires a relatively expensive installation cost. Furthermore, although a portable TV receiver has become popular in recent years, it is difficult to carry the satellite TV reception system to any place where users may travel.

A flat antenna apparatus such as a synthetic aperture array antenna apparatus for satellite TV reception also has been developed. Such a flat antenna apparatus can be moved relatively easily. However, a complete satellite TV receiving system including the flat antenna apparatus, a satellite receiver and a TV receiver has a relatively large volume and is heavy. Therefore, it is still difficult to carry the satellite TV reception system to any place where users may travel.

SUMMARY OF THE INVENTION

It is, therefore, an object of the present invention to provide an antenna apparatus for satellite communication, which is able to be easily carried.

In order to achieve the above object, a portable satellite broadcast signal antenna apparatus for manually transporting a satellite signal converter includes an antenna device for receiving the satellite broadcast signals, a device for adjusting the angle of the antenna device with respect to a predetermined plane for aligning the antenna device with a satellite, and a housing defining an interior space for receiving the satellite signal converter and the angle adjusting device therein and having an exterior surface bearing the antenna device.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
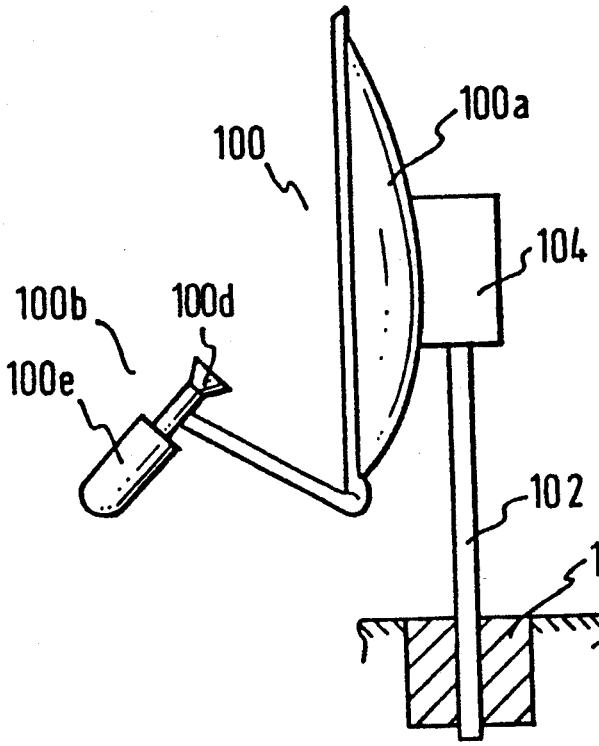
Fig. 1 (Prior Art)
FIG. 1 is a side view showing an example of a conventional parabola antenna apparatus for satellite communication.

The present invention will be described in detail with reference to FIGS. 2 through 14. Throughout drawings, reference numerals or letters used in FIG. 1 (Prior Art) will be used to designate like or equivalent elements for simplicity of explanation.

Figure 2:
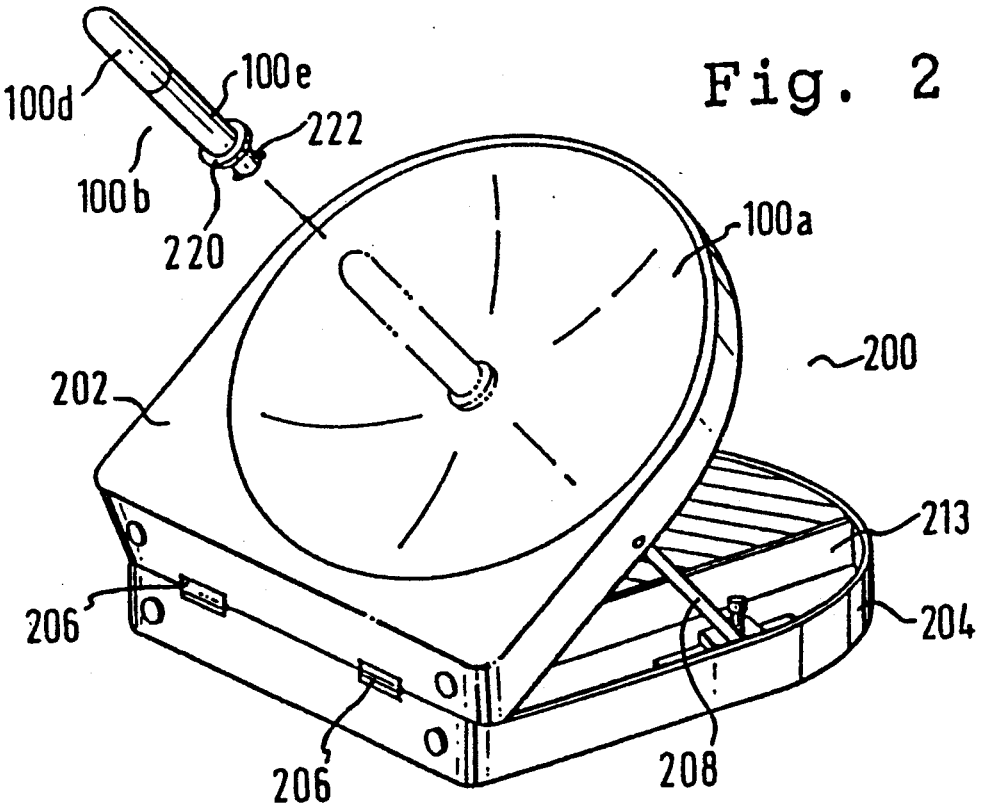
FIG. 2 is a perspective view showing a first embodiment of the antenna apparatus according to the present invention.

Referring now to FIG. 2, a first embodiment of the antenna apparatus for satellite communication according to the present invention will be described in detail. FIG. 2 is a perspective view showing the first embodiment of the antenna apparatus, e.g., a satellite TV reception antenna apparatus.

As shown in FIG. 2, the satellite TV reception antenna apparatus 200 according to the first embodiment of the present invention is made almost in the shape of a suitcase or a trunk. The satellite TV reception antenna apparatus 200 comprises two sections, i.e., an antenna section 202 and a base section 204 which correspond to the lid and the housing of a suitcase, respectively. The antenna section 202 and the base section 204 are swingably coupled together at their one ends with fasteners 206. Further the elevation angle adjuster 208 is provided between the antenna section 202 and the base section 204 so as to hold the angle therebetween at a suitable amount.

The antenna section 202 is formed into a parabolic reflector 100*a* on its outer surface. An outer unit 100*b* is removably mounted on the center of the parabolic reflector 100*a*. The outer unit 100*b* comprises an antenna element, i.e. primary feeder 100*d*, an LNB converter 100*e* and a coupling mount 210. The primary feeder 100*d* is located on the focus of the parabolic reflector 100*a* for inducing 12 GHz band microwave radio signals corresponding to broadcast waves transmitted from satellites. The LNB converter 100*e* is coupled to the primary feeder 100*d* for both amplifying the received signals and converting the received signals to prescribed lower frequency band signals, e.g., 1 GHz signals. The coupling mount 210 is provided on one end of the outer unit 100*b* for coupling the outer unit 100*b* to the parabolic reflector 100*a*.

The outer unit 100*b* can be removed from the parabolic reflector 100*a*. Thus, the outer unit 100*b* is housed in a suitable portion of the base section 204 when the antenna apparatus is not used.

Figure 3:
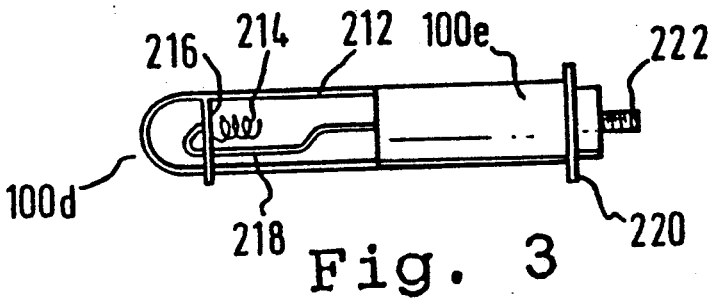
FIG. 3 is a section showing in part the antenna element **100*d* of FIG. 2**.

Referring now to FIG. 3, an example of the outer unit 100*b* will be described in detail. FIG. 3 is a section showing in part the primary feeder 100*d*. As shown in FIG. 3, the primary feeder 100*d* is constructed on one end of the outer unit 100*b*. The primary feeder 100*d* comprises a feed dome or feedome 212 and a helical antenna 214. The helical antenna 214 is mounted on a reflector 216 provided in the feedome 212. The helical antenna 214 is positioned at the focus of the parabolic reflector 100*a* when the outer unit 100*b* is coupled thereto. The helical antenna 214 is coupled to the LNB converter 100*e* through a coaxial cable 218. The coupling mount 210 is mounted on the other end of the outer unit 100*b*. The coupling mount 210 comprises a rib 220 and an output connector 222. When the outer unit 100*b* is mounted on the parabolic reflector 100*a*, the output connector 222 is electrically coupled to a prescribed output terminal (not shown) of the antenna apparatus, and the rib 220 positions the helical antenna 214 at the focus of the parabolic reflector 100*a*.

The base section 204 has a housing space formed inside thereof. The housing space is divided into sections by partition walls 213 so that the outer unit 100*b*, a satellite receiver and the like are temporarily housed in given sections of the housing space, respectively, when the antenna apparatus is not used.

Figure 4:
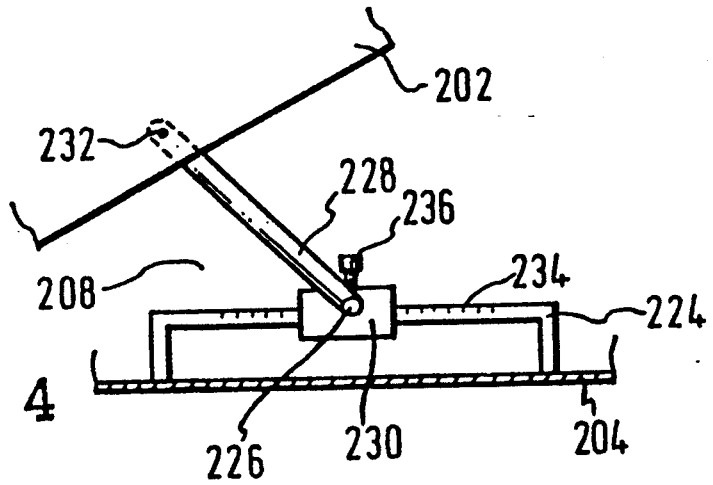
FIG. 4 is a side elevation view showing the elevation angle adjuster 208 of FIG. 2.

The elevation angle adjuster 208 will be described in detail here in reference to FIG. 4. FIG. 4 is a side elevation view showing the elevation angle adjuster 208. As shown in FIG. 4, the elevation angle adjuster 208 is suspended between the antenna section 202 and the base section 204. The elevation angle adjuster 208 comprises a guide rail 224, a slider 226 and a stay 228. The guide rail 224 is mounted on the base section 204. The slider 226 is slidably mounted on the guide rail 224. One end of the stay 228 is rockably held on the slider 226 through a pin 230. The other end of the stay 228 is also rockably held on the antenna section 202 through a pin 232.

The guide rail 224 bears a scale 234 indicating elevation angles. Thus, a user can set the antenna section 202 to the right elevation angle for a selected satellite in accordance with the scale 234 on the guide rail 224. The slider 226 is fixed to the right position on the guide rail 224 with a lock screw 236, in correspondence with the elevation angle.

The azimuth angle of the antenna section 202 can be adjusted to the right position by rotating the base section 204 in the horizontal plane.

During the adjustments of the elevation angle and the azimuth angle, their right positions are confirmed by monitoring images on a TV receiver.

Figure 5:
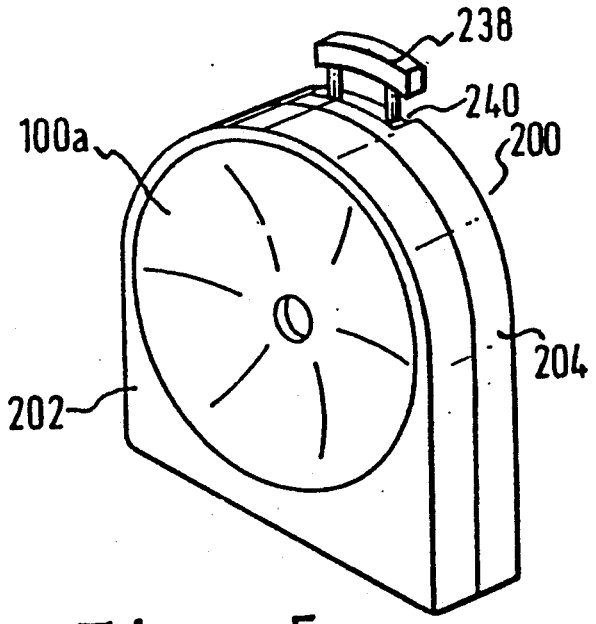
FIG. 5 is a perspective view showing the antenna apparatus of FIG. 2 in the closed state.

In the first embodiment of the present invention as described above, the antenna section 202 and the base section 204 are closed compactly together, as shown in FIG. 5, when the antenna apparatus is not used. FIG. 5 is a perspective view showing the antenna apparatus in the closed state.

The antenna apparatus according to the present invention can be provided with a carrying handle 238, as shown in FIG. 5. The carrying handle 238 is engaged in a recess 240 formed on the top end of the base section 204 during the satellite TV reception. The carrying handle 238 is then pulled out from the recess 240 for carrying, as shown in FIG. 5.

The outer unit 100*b* and other necessities, such as a satellite receiver are housed in the housing space of the base section 204 at that time. Thus, the antenna apparatus is very portable. A user can easily carry the antenna apparatus and other necessities for satellite TV reception together with a TV receiver, in his or her traveling or picnicing.

Furthermore, the elevation angle and the azimuth angle of the antenna section 202 can be easily set to the right positions with the elevation angle adjuster 208 and the base section 204, when the antenna apparatus is used.

Figure 6:
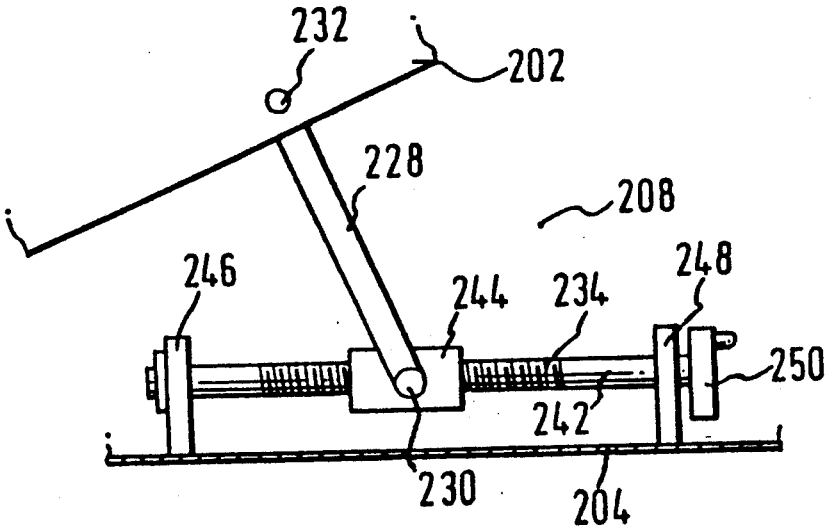
FIG. 6 is a side elevation view showing a modification of the elevation angle adjuster 208.

Referring now to FIG. 6, another example of the elevation angle adjuster 208 will be described in detail. FIG. 6 is a side elevation view showing the elevation angle adjuster 208. As shown in FIG. 6, the elevation angle adjuster 208 is suspended between the antenna section 202 and the base section 204. The elevation angle adjuster 208 comprises a screw rod 242, a traveling nut 224 and a stay 228. The screw rod 242 is rotatably mounted between a pair of stands 246 and 248 mounted on the base section 204. A wheel handle 250 is provided on one end of the screw rod 242. The traveling nut 244 is engaged to the screw rod 242 so that the traveling nut 244 travels along the screw rod 242 when the screw rod 242 is rotated. The screw rod 242 is rotated by operating the wheel handle. One end of the stay 228 is rockably held on the traveling nut 244 through a pin 230. The other end of the stay 228 is also rockably held on the antenna section 202 through a pin 232.

A portion of the base section 204 facing the screw rod 242 bears a scale (not shown) indicating elevation angles. Thus, a user can set the antenna section 202 to the right elevation angle for a selected satellite in accordance with the scale. The traveling nut 244 is held at the right position on the screw rod 242 when the wheel handle 250 is not operated.

Figure 7:
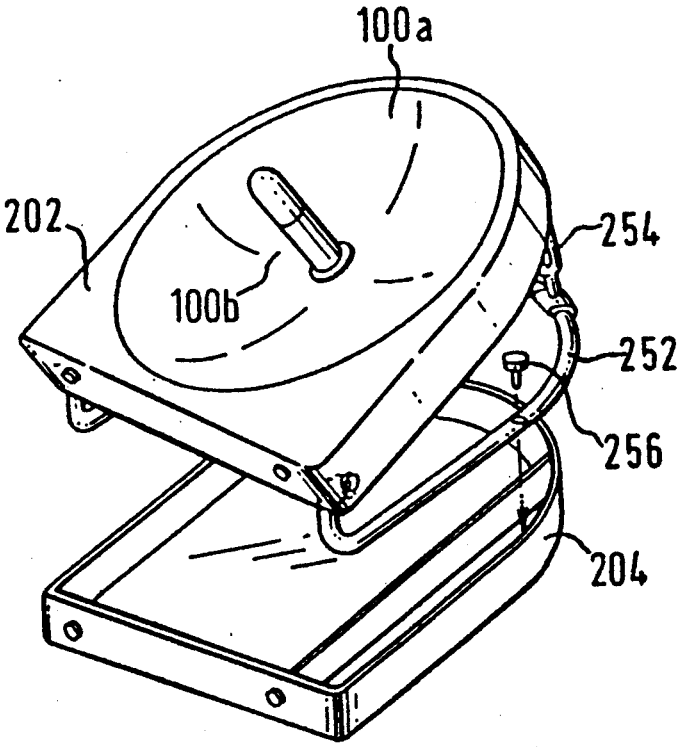
FIG. 7 is an exploded perspective view showing a second embodiment of the antenna apparatus according to the present invention.

Referring now to FIG. 7, a second embodiment of the satellite TV reception antenna apparatus according to the present invention will be described in detail. FIG. 7 is an exploded perspective view showing the second embodiment of the antenna apparatus.

As shown in FIG. 7, the satellite TV reception antenna apparatus 200 according to the second embodiment of the present invention is also made in the shape of a suitcase or a trunk, similar to the first embodiment. That is, the satellite TV reception antenna apparatus 200 comprises two sections, i.e., an antenna section 202 and a base section 204 which correspond to the lid and the housing of a suitcase, respectively. The antenna section 202 and the base section 204 are coupled together via the elevation angle adjuster 208, which will be described below.

The elevation angle adjuster 208 comprises a stand 252 and a turnbuckle 254. The stand 252 is formed in almost a shape of horse-shoe. Both ends of the stand 252 are rockably engaged to side walls of the antenna section 202 at near a bottom end thereof. The stand 252 is then removably mounted on the base section 204 with screws 256. Thus, the antenna section 202 is swingably coupled to the base section 204.

The turnbuckle 254 is suspended between the antenna section 202 and the stand 252. One end of the turnbuckle 254 is rockably coupled to around the middle portion of the stand 252. The other end of the turnbuckle 254 is releasably coupled to around the top end of the antenna section 202 with a conventional coupling structure (not shown).

The second embodiment of the satellite TV reception antenna apparatus 200 further comprises an outer unit 100*b*. The outer unit 100*b*, the antenna section 202 and the base section 204 of the second embodiment have constructions similar to those of the first embodiment. Accordingly, explanations of the outer unit 100*b*, the antenna section 202 and the base section 204 will be omitted here.

A length of the turnbuckle 254 can be easily varied, as is well known. Thus, in the second embodiment of the satellite TV reception antenna apparatus 200, a user can set the antenna section 202 to the right elevation angle for a selected satellite by varying the length of the turnbuckle 254. Further, the turnbuckle 254 can be housed in the housing space of the base section 204 when the antenna apparatus is not used. That is, the other end of the turnbuckle 254 is released from the antenna section 202 at that time. Then, the turnbuckle 254 is layed in the housing space of the base section by operating the turnbuckle 254 around the one end thereof coupled to the stand 252.

Further, according to the second embodiment of the satellite TV reception antenna apparatus 200, the antenna section 202 and the base section 204 can be separated. Thus, the antenna section 202 is set in a remote place from the base section, as the antenna section being provided with the elevation angle adjuster 208, i.e., the stand 252 and the turnbuckle 254. Thus, a wide use of the antenna apparatus is obtained, as compared to the first embodiment.

Figure 8:
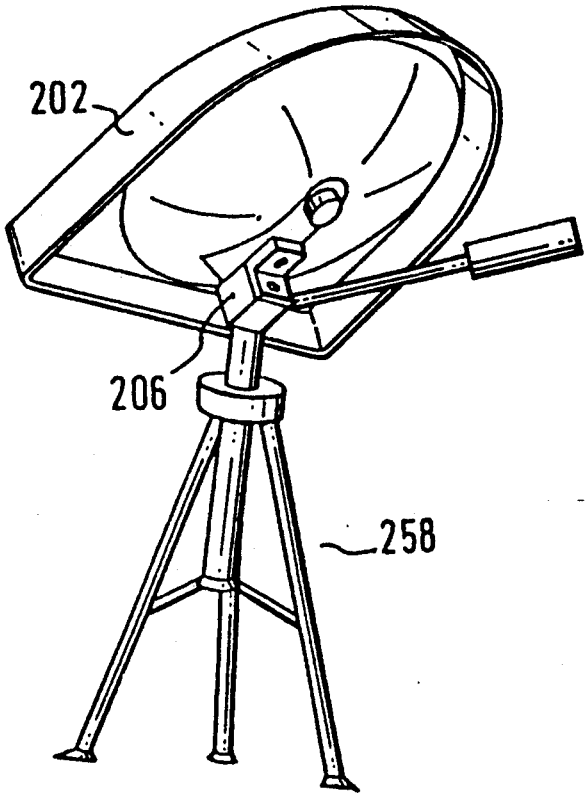
FIG. 8 is a perspective view showing a modification of the antenna section 202 in the state that the antenna section 202 is mounted on a typical tripod 258.

Referring now to FIG. 8, a modification of the antenna section 202 will be described in detail. FIG. 8 is a perspective view showing the antenna section 202 in the state that the antenna section 202 is mounted on a typical tripod 258 which is widely used for cameras. The antenna section 202 is provided with a typical socket (not shown) adapted for use of camera. Thus, the antenna section 202 can be mounted on a pan head 260 of the tripod 258.

According to the modification of the antenna section 202, both the elevation angle and the azimuth angle of the parabolic reflector 100*a* can be easily adjusted by operating the tripod 258.

Figure 9:
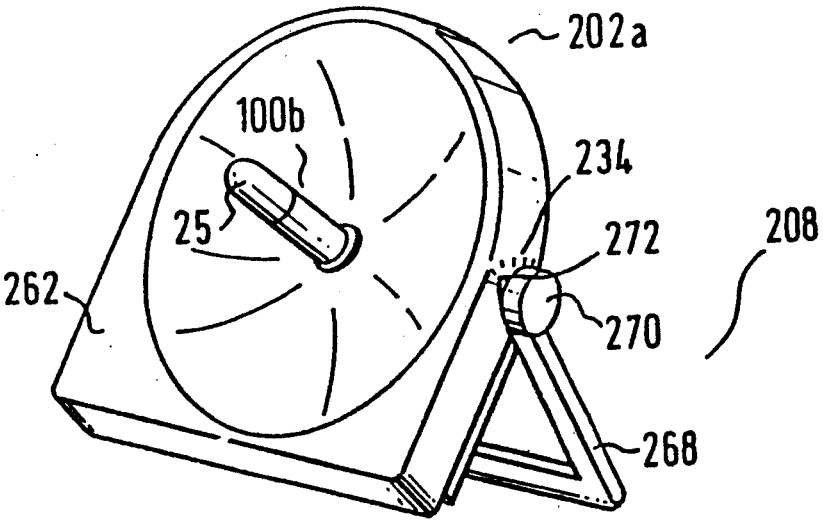
FIGS. 9 and 10 are perspective views showing front and rear sides of the third embodiment of the antenna apparatus.
Figure 10:
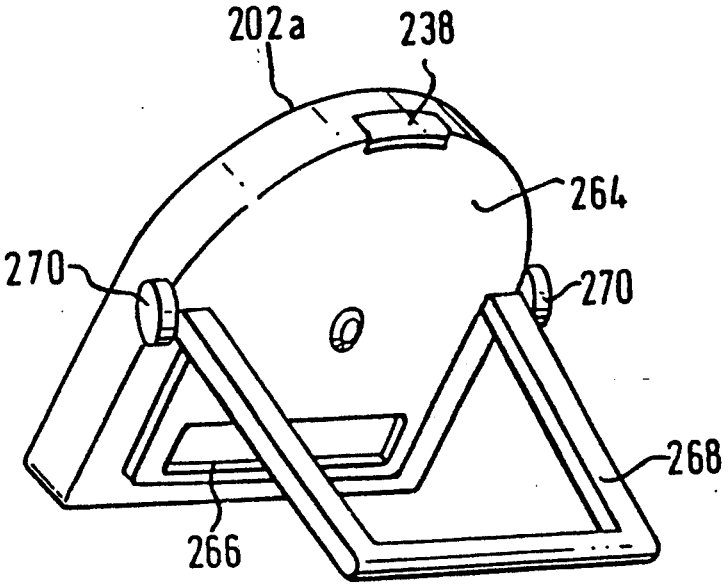
Figure 11:
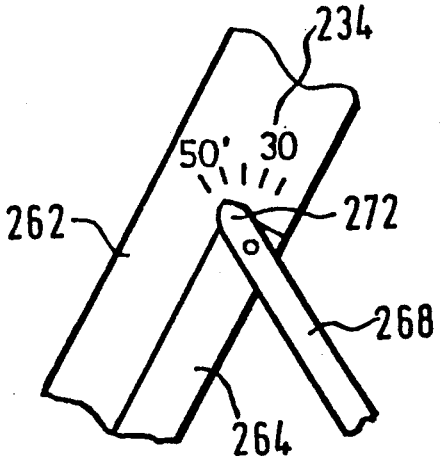
FIG. 11 is a partial side view of a third embodiment of the antenna apparatus.

Referring now to FIGS. 9, 10 and 11, a third embodiment of the satellite TV reception antenna apparatus according to the present invention will be described in detail. FIGS. 9 and 10 are perspective views showing front and rear sides of the third embodiment of the antenna apparatus, respectively. FIG. 11 is a partial side view of the third embodiment of the antenna apparatus.

As shown in FIGS. 9 and 10, the satellite TV reception antenna apparatus 200 according to the third embodiment of the present invention is formed almost in the shape of box, as described later. The satellite TV reception antenna apparatus 200 comprises an antenna section 202*a* and the elevation angle adjuster 208. The antenna section 202*a* is constructed in the shape of relatively flat box. Thus, the antenna section 202*a* has a housing space therein. The housing space generally contains a satellite receiver or the like.

A front half 262 of the antenna section 202*a* has a construction similar to the antenna section 202 of the first and second embodiments. That is, the front half 262 bears a parabolic reflector 100*a*, as shown in FIG. 9.

A rear half 264 of the antenna section 202*a* bears a slot 266, as shown in FIG. 10. The slot 266 is adapted for removably receiving an apparatus, e.g., an outer unit 100*b* or the like, in the housing space of the antenna section 202*a*. The slot 266 is usually closed with a suitable cover (not shown).

The elevation angle adjuster 208 comprises a U-shaped stand 268 and a pair of screw knobs 270. Both ends of the U-shaped stand 268 are rockably mounted to side walls of the antenna section 202*a* with the screw knobs 270. Thus, the antenna section 202*a* is directed toward a selected satellite. The elevation angle of the parabolic reflector 100*a* is adjusted by operating the U-shaped stand 268. When a right position of the elevation angle is obtained, the right position is held securely by tightening the screw knobs 270.

The side walls of the antenna section 202*a* bears a scale 234 indicating elevation angles, as shown in FIG. 11. While, one end of the stand 268 is formed in the shape of a pointer 272. Thus, a user can set the antenna section 202*a* to the right elevation angle for a selected satellite in reference to the scale 234 and the pointer 272. The stand 268 is fixed to the right position in reference to the antenna section 202*a* with the screw knobs 270.

Figure 12:
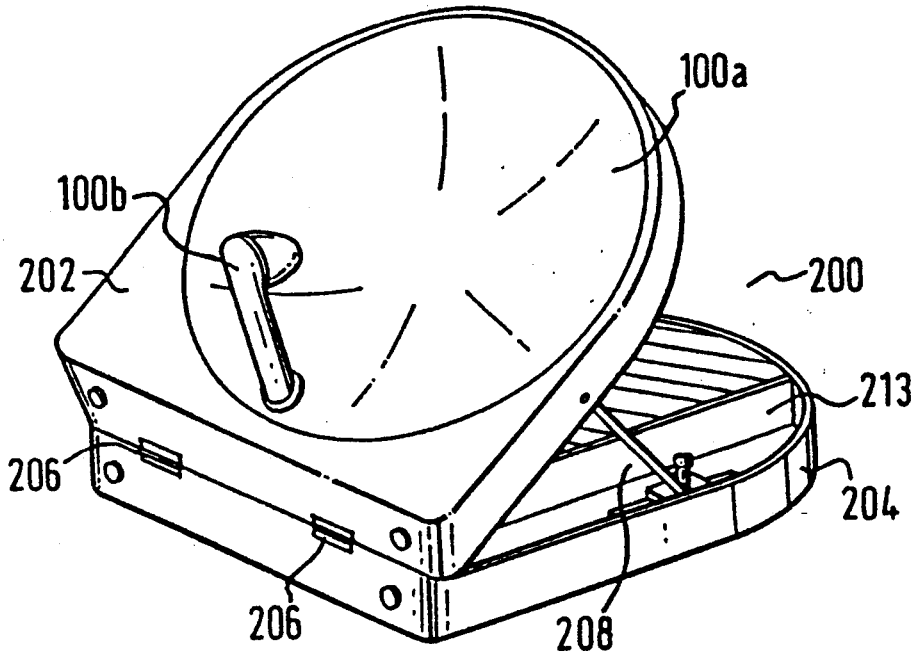
FIG. 12 is a perspective view showing a fourth embodiment of the antenna apparatus.
Figure 13:
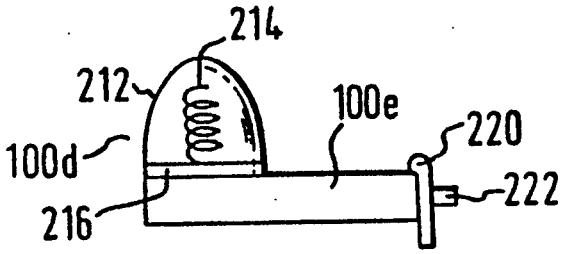
FIG. 13 is a section showing in part the primary feeder 100*d* of FIG. 12.

Referring now to FIGS. 12 and 13, a fourth embodiment of the antenna apparatus for satellite communication will be described. FIG. 12 is a perspective view showing the fourth embodiment of the antenna apparatus, e.g., a satellite TV reception antenna apparatus. FIG. 13 is a section showing in part the primary feeder 100*d* of FIG. 12.

As shown in FIG. 12, the satellite TV reception antenna apparatus 200 according to the fourth embodiment of the present invention is made almost similar to the first embodiment, as shown in FIG. 2, except that the outer unit 100*b* is coupled to the antenna section 202 of the antenna apparatus 200 so that the outer unit 100*b* is positioned at the offset focus of the parabolic reflector 100*a*.

As shown in FIG. 13, the outer unit 100*b* of the fourth embodiment is similar to the outer unit 100*b* shown in FIG. 3, except that the primary feeder 100*d* is mounted on the side portion of the LNB converter 100*e*. The coupling mount 210 of the outer unit 100*b* is coupled to the edge portion of the parabolic reflector 100*a*. Thus, the helical antenna 214 of the primary feeder 100*d* is positioned on the offset focus of the parabolic reflector 100*a*.

Figure 14:
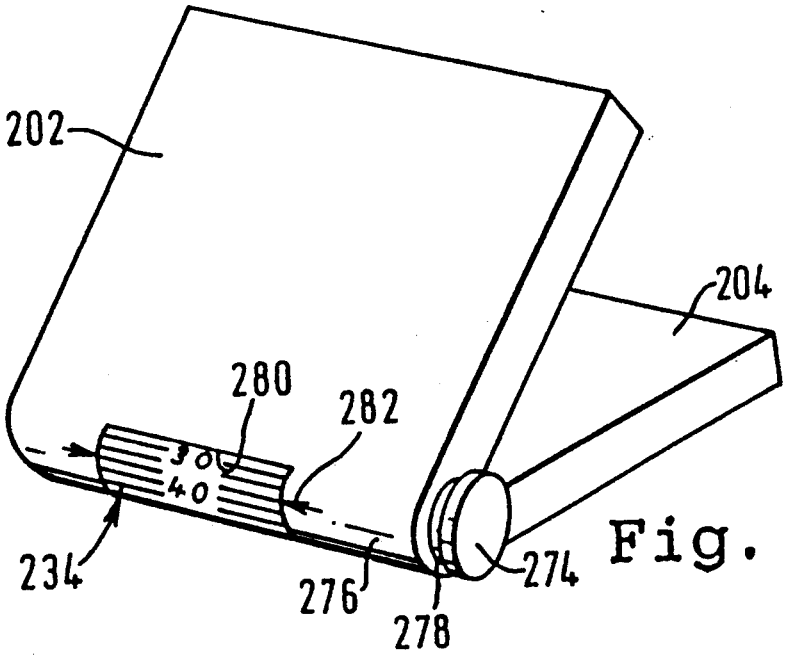
FIG. 14 is a perspective view showing a fifth embodiment of the antenna apparatus according to the present invention.

Referring now to FIG. 14, a fifth embodiment of the satellite TV reception antenna apparatus according to the present invention will be described in detail. FIG. 14 is a perspective view showing the fifth embodiment of the antenna apparatus.

As shown in FIG. 14, the satellite TV reception antenna apparatus 200 according to the fifth embodiment comprises an antenna section 202 and a base section 204. The antenna section 202 and the base section 204 are formed in almost the shape of a rectangular block, respectively. The antenna section 202 contains a typical flat type microwave antenna device such as a synthetic aperture array antenna device (not shown) inside thereof. On the other hand, the base section 204 contains an LNB converter and a satellite receiver (both not shown) in a housing space thereof. The antenna section 202 and the base section 204 are rockably coupled through the elevation angle adjuster 208.

The elevation angle adjuster 208 is comprised of a screw knob 274 and ends, i.e., coupling ends 276, 278, of the antenna section 202 and the base section 204. That is, the coupling ends 276 and 278 of the antenna section 202 and the base section 204 are rockably coupled to each other.

The coupling end 276 of the antenna section 202 has a window 280 so that a part of the coupling end 278 of the base section 204 is exposed through the window 280. The exposed portion of the coupling end 278 bears a scale 234 indicating elevation angles. The coupling end 276 of the antenna section 202 bears a pointer mark 282. Thus, a user can set the antenna section 202 to the right elevation angle for a selected satellite in reference to the scale 234 and the pointer mark 282. The antenna section 202 is fixed to the right position in reference to the base section 204 by tightening the screw knob 274.

As described above, the present invention can provide an extremely preferable portable satellite TV reception antenna apparatus.

While there have been illustrated and described what are at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teaching of the present invention without departing from the central scope thereof. Therefore, it is intended that this invention not be limited to the particular embodiment disclosed as the best mode contemplated for carrying out this invention, but that the invention include all embodiments falling within the scope of the appended claims.

What is claimed is:

1. A portable satellite broadcast signal antenna apparatus for satellite communication, comprising:

antenna means for receiving satellite broadcast signals and including a parabolic reflector;

manually transportable housing means having an exposed exterior surface; and means for adjusting an angle of the antenna means with respect to a predetermined plane for aligning the antenna means with a satellite;

said parabolic reflector of said antenna means being disposed directly on said exterior surface;

said antenna means further including an outer unit accommodating a satellite signal converter and being removably-connectable to said housing means to be mounted on said parabolic reflector;

said housing means having an interior space for receiving therein said angle adjusting means and further defining in said interior space means for accommodating said outer unit when said outer unit is removed from said parabolic reflector and the apparatus is not in use, said housing means including access means for manually inserting thereinto and removing therefrom a tuner, wherein the housing means includes a unitary housing having opposite sides, said antenna means including a microwave antenna mounted on one side of the unitary housing, and the access means includes an opening in the unitary housing on another side thereof.

2. The apparatus of claim 1, wherein the angle adjusting means includes a support member hingedly attached to the unitary housing for movement thereon between a closed position in which the support member lies against the unitary housing in substantially the same plane thereof, and an open position in which the support member extends outward from the unitary housing at an angle with respect to a plane of the unitary housing.

3. The apparatus of claim 2, wherein the support member is U-shaped.

4. A portable satellite broadcast signal antenna apparatus for satellite communication, comprising:

antenna means for receiving satellite broadcast signals and including a parabolic reflector;

manually transportable housing means having an exposed exterior surface; and means for adjusting an angle of the antenna means with respect to a predetermined plane for aligning the antenna means with a satellite;

said parabolic reflector of said antenna means being disposed directly on said exterior surface;

said antenna means further including an outer unit accommodating a satellite signal converter and being removably-connectable to said housing means to be mounted on said parabolic reflector;

said housing means having an interior space for receiving therein said angle adjusting means and further defining in said interior space means for accommodating said outer unit when said outer unit is removed from said parabolic reflector and the apparatus is not in use, said housing means including a base and a cover, said parabolic reflector being mounted to said cover, and the base being hinged to the cover for movement between a closed position in which the cover abuts against the base to form therebetween the interior space, and an open position in which the parabolic reflector and the outer unit connected thereto is angled with respect to a plane of the base.

5. A portable satellite broadcast signal antenna apparatus for satellite communication, comprising:

antenna means for receiving satellite broadcast signals and including a parabolic reflector;

manually transportable housing means having an exposed exterior surface; and means for adjusting an angle of the antenna means with respect to a predetermined plane for aligning the antenna means with a satellite;

said parabolic reflector of said antenna means being disposed directly on said exterior surface;

said antenna means further including an outer unit accommodating a satellite signal converter and being removably-connectable to said housing means to be mounted on said parabolic reflector;

said housing means having an interior space for receiving therein said angle adjusting means and further defining in said interior space means for accommodating said outer unit when said outer unit is removed from said parabolic reflector and the apparatus is not in use, said housing means including a base and a cover for attachment thereto, said antenna means being mounted to the cover, the base and the cover being separable from each other, and said angle adjusting means including a support member hinged to the cover for selectively supporting the cover at varying angles to the base.

6. The apparatus of claim 5, wherein the angle adjusting means includes a threaded socket in the cover; and further including an adjustable tripod for attachment to the socket.

* * * * *